US006375501B1

(12) United States Patent
Kojima

(10) Patent No.: US 6,375,501 B1
(45) Date of Patent: Apr. 23, 2002

(54) TERMINAL FITTING AND A CONNECTOR

(75) Inventor: Eiji Kojima, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/684,532

(22) Filed: Oct. 6, 2000

(30) Foreign Application Priority Data

Oct. 22, 1999 (JP) ..... 11-301295

(51) Int. Cl.[7] ..... H01R 13/40
(52) U.S. Cl. ..... 439/595; 439/752.5; 439/382
(58) Field of Search ..... 439/752, 397–400, 439/595; 29/842, 758, 747, 752.5

(56) References Cited

U.S. PATENT DOCUMENTS

| | | | | |
|---|---|---|---|---|
| 4,380,118 A | | 4/1983 | Driver et al. | 29/747 |
| 5,575,061 A | | 11/1996 | Tsuji et al. | 29/863 |
| 5,743,008 A | * | 4/1998 | End et al. | 439/752 |
| 6,146,215 A | * | 11/2000 | Matsushita et al. | 439/752 |
| 6,149,462 A | * | 11/2000 | Sugie | 439/752 |

FOREIGN PATENT DOCUMENTS

| | | |
|---|---|---|
| EP | 0 622 867 | 11/1994 |
| EP | 0 920 082 | 6/1999 |

* cited by examiner

*Primary Examiner*—P. Austin Bradley
*Assistant Examiner*—Briggitte R. Hammond
(74) *Attorney, Agent, or Firm*—Anthony J. Casella; Gerald E. Hespos

(57) ABSTRACT

A terminal fitting (20) is formed with a jig contact portions (24) with which a pushing jig (30) is to be brought to contact. The jig contact portion (24) are provided with a loose movement restricting function for restricting a loose movement of the terminal fitting (20) in a cavity (11) in a direction intersecting with an inserting direction of the terminal fitting (20) by coming into contact with a ceiling wall (11A) of the cavity (11). Since the jig contact portions (24) also have the loose movement restricting function, it is not necessary to form a loose movement-restricting portion separately from the jig contact portion (24). This enables an avoidance of a complicated shape and an enlarged size of the entire terminal fitting (20).

14 Claims, 6 Drawing Sheets

TERMINAL FITTING AND A CONNECTOR

BACKGROUND OF THE INVENTION

1. Field of the Invention

The present invention relates to a terminal fitting and to a connector comprising the same.

2. Description of the Related Art

The prior art includes a method for connecting a wire with an insulation-displacement terminal that was previously mounted in a connector housing. The prior art also includes a method for connecting a wire with an insulation-displacement terminal outside a connector housing and then inserting the terminal fitting connected with the wire into the connector housing. An example of the latter method is disclosed in U.S. Pat. No. 5,575,061.

The insulation-displacement terminal fitting connected with the wire may be inserted into a cavity formed in the connector housing by gripping and pushing the wire. However, the wire may buckle or deform due to an insertion resistance, thereby hindering a smooth insertion of the terminal fitting. In other instances, the wire may be displaced relative to the terminal fitting in a manner that causes a contact failure. Accordingly, it is preferable to insert the terminal fitting by pushing directly on the terminal fitting with a pushing jig. The terminal fitting that is to be inserted with a pushing jig is formed with a jig contact portion with which the pushing jig is engaged.

The cavity in the prior art connector housing typically has substantially constant height and width over its entire length. However, the terminal fitting has a height and width that varies along the length. More particularly, respective areas along the length of the terminal fitting have shapes and dimensions suitable for their functions. Thus, when the terminal fitting is inserted into the cavity, a large space often is defined between a part of the terminal fitting and the cavity. As a result, the terminal fitting may loosely move in a direction that intersects the insertion direction of the terminal fitting into the cavity. Some prior art terminal fittings are formed with a stabilizer to prevent loose movement in the cavity.

A terminal fitting secured to the wire outside the connector housing may be formed with both a jig contact portion with which the pushing jig is engaged and a loose movement restricting portion for restricting a loose movement of the terminal fitting in the cavity. However, if these two portions are provided, the terminal fitting may have a more complicated shape and a larger size.

In view of the above, an object of the present invention is to provide a terminal fitting and a corresponding connector which avoid complicating the shape and enlarging the size of a terminal fitting that is inserted into a connector housing by a pushing jig and that is designed to restrict loose movement in the connector housing.

SUMMARY OF THE INVENTION

The subject invention is directed to a terminal fitting that is to be connected with a wire outside a connector housing and that is to be inserted into a cavity formed in the connector housing by a pushing jig or other inserting means after being connected with the wire. The terminal fitting comprises at least one jig contact portion for engagement by the pushing jig. The jig contact portion performs a loose movement restricting function by contacting an inner wall of the cavity for restricting a loose movement of the terminal fitting in the cavity in a direction that intersects an insertion direction of the terminal fitting. Thus, it is not necessary to form a loose movement-restricting portion separately from the jig contact portion. This avoids both a complicated shape and an enlarged size for the entire terminal fitting.

According to a preferred embodiment of the invention, the jig contact portion projects in a direction that intersects the insertion direction of the terminal fitting. An edge of the jig contact portion that extends along this projecting direction serves as a receiving portion for receiving the pushing jig. Another edge of the jig contact portion serves as a contact portion that contacts the inner wall of the cavity. Since the jig contact portion projects in a direction that intersects the insertion direction of the terminal fitting into the cavity, it is allowed to have a simple shape.

A projecting end of the jig contact portion preferably is formed with a guide that extends oblique to the insertion direction of the terminal fitting into the cavity. The guide will contact the entrance to the cavity during insertion into the cavity, and the contact will correct the orientation of the terminal fitting even if the terminal fitting is moved loosely in the projecting direction of the jig contact portion. Thus, a smooth insertion into the cavity is enabled.

The jig contact portion preferably projects along an inner wall surface of the cavity in a direction that intersects the insertion direction of the terminal fitting into the cavity, and a slanted escaping surface preferably is formed on an outer end surface of the jig contact portion. Thus, even if the jig contact portion is displaced such that its projecting end is inclined outwardly, the slanted escaping surface prevents the projecting end edge of the jig contact portion from being caught by the opening edge of the entrance to the cavity.

According to a further preferred embodiment, inner surfaces of upper end portions of the jig contact portion comprise slanted guide surfaces for guiding the wire that will be connected with the terminal fitting.

The subject invention also is directed to a connector comprising a connector housing having at least one cavity for receiving at least one of the above-described terminal fittings. The terminal fitting may be inserted at least partly into the cavity by a pushing jig or other inserting means. Preferably, the connector housing comprises a terminal-inserting opening with at least one slanted guide surface for guiding the terminal fitting into the cavity.

According to a preferred embodiment of the invention, the terminal fitting comprises contact portions that can be brought into contact with the inner wall of the cavity and a connecting portion to be connected with a mating terminal fitting. A height of the contact portions of the terminal fitting is adjusted in view of: the clearance above and/or below the connecting portion; the dimension of the connecting portion in forward and backward directions; the distance between the connecting portion and the jig contact portion in forward and backward directions; and the shapes and elasticity limits of the various portions of the terminal fitting, such that the loose movement amount lies within a range of elasticity of the terminal fitting.

These and other objects, features and advantages of the present invention will become apparent upon reading of the following detailed description of preferred embodiments and accompanying drawings.

DETAILED DESCRIPTION OF THE PREFERRED EMBODIMENT

Figure 1:
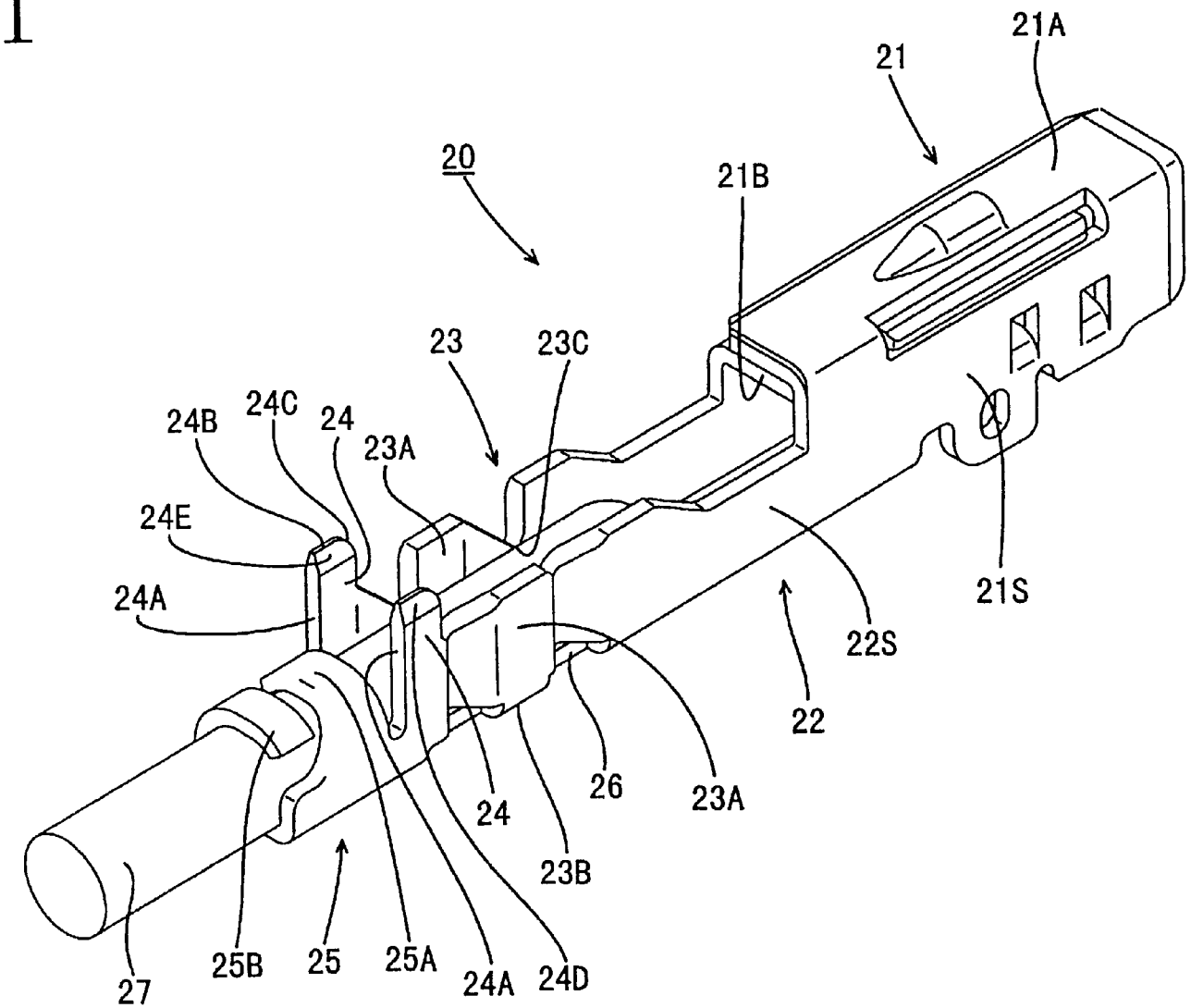
FIG. 1 is a perspective view of a terminal fitting according to one embodiment of the present invention.
Figure 2:
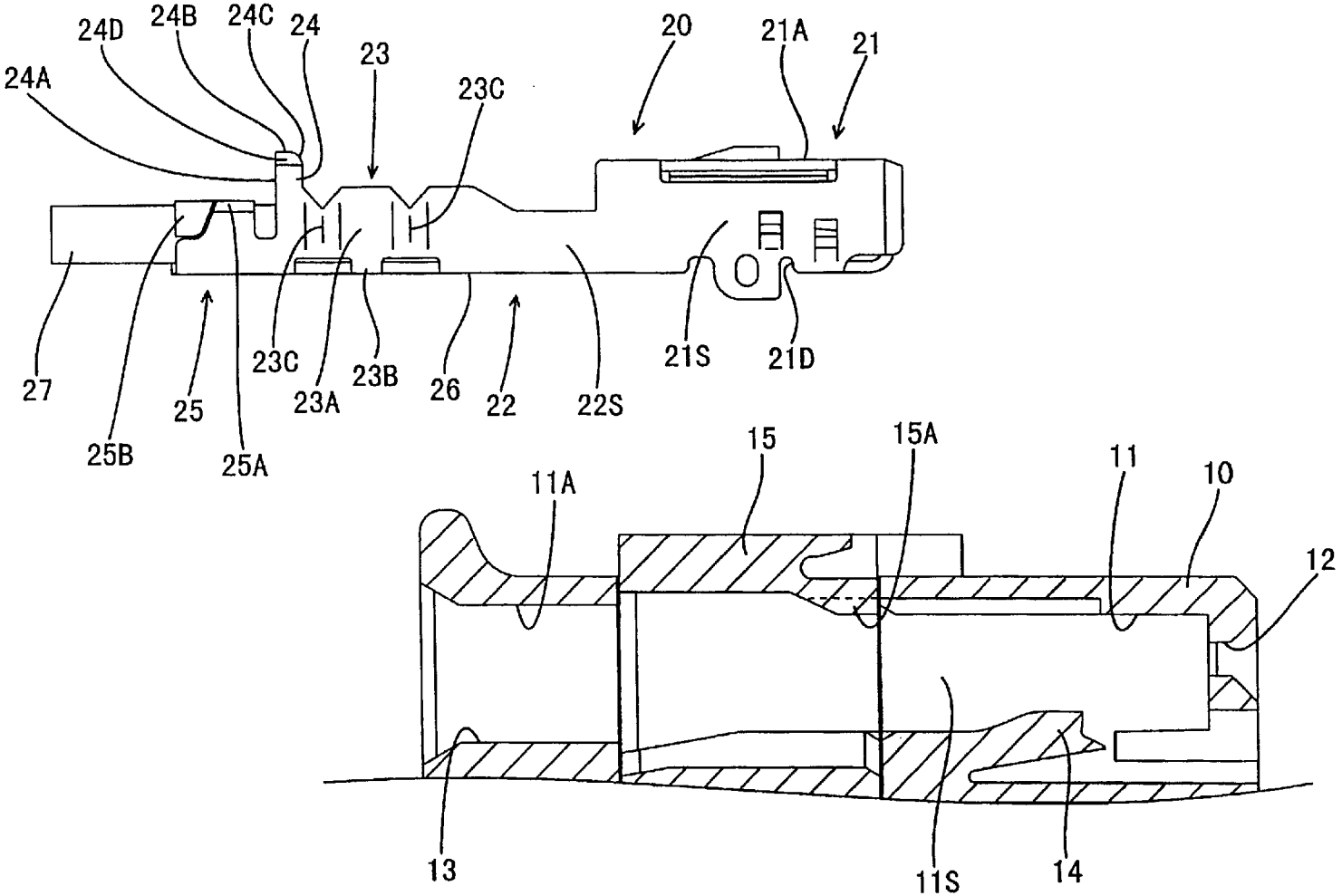
FIG. 2 is a side view of the terminal fitting separate from a connector housing shown in section.
Figure 3:
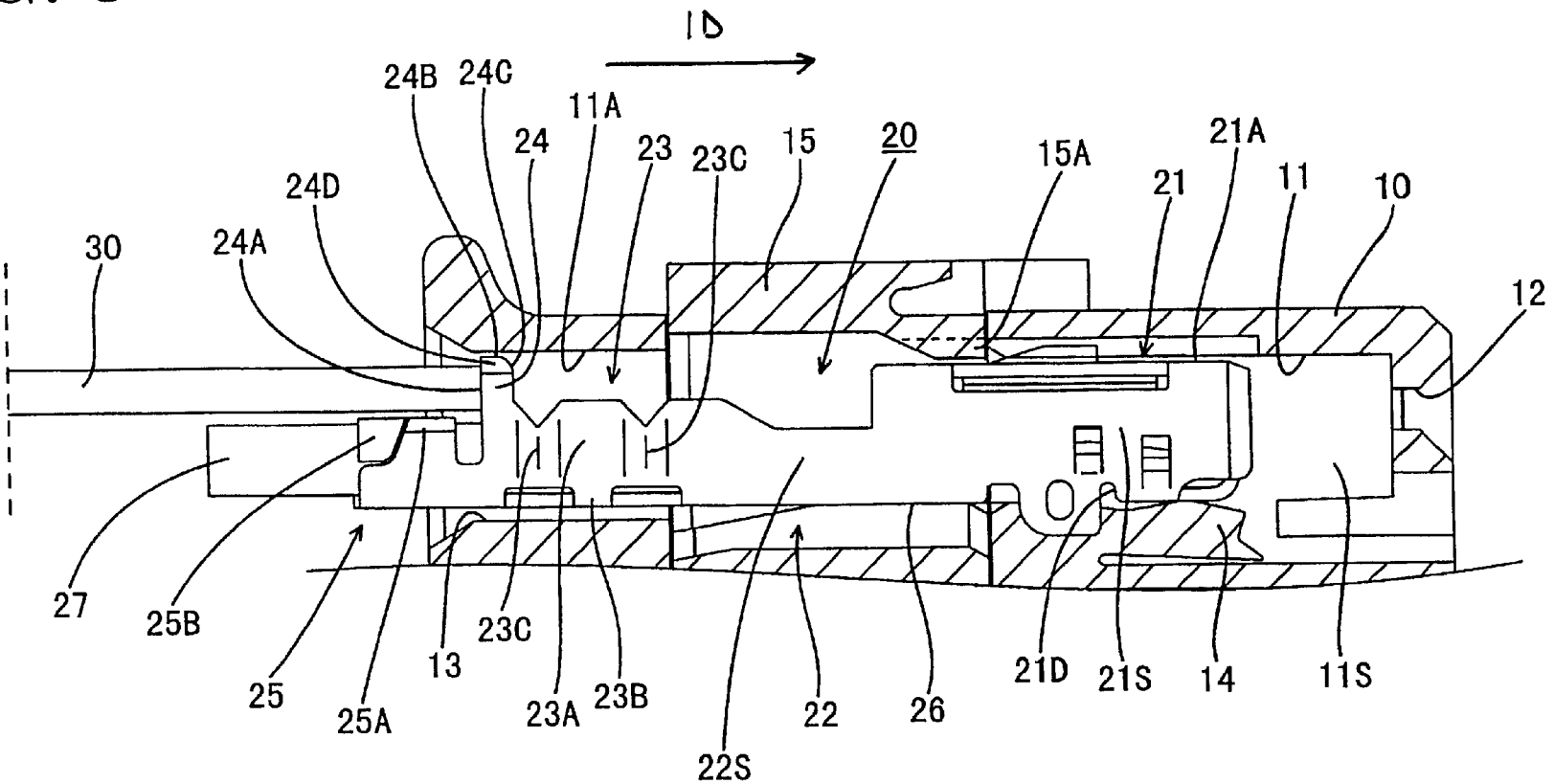
FIG. 3 is a section showing an intermediate stage of insertion of the terminal fitting into the connector housing.
Figure 4:
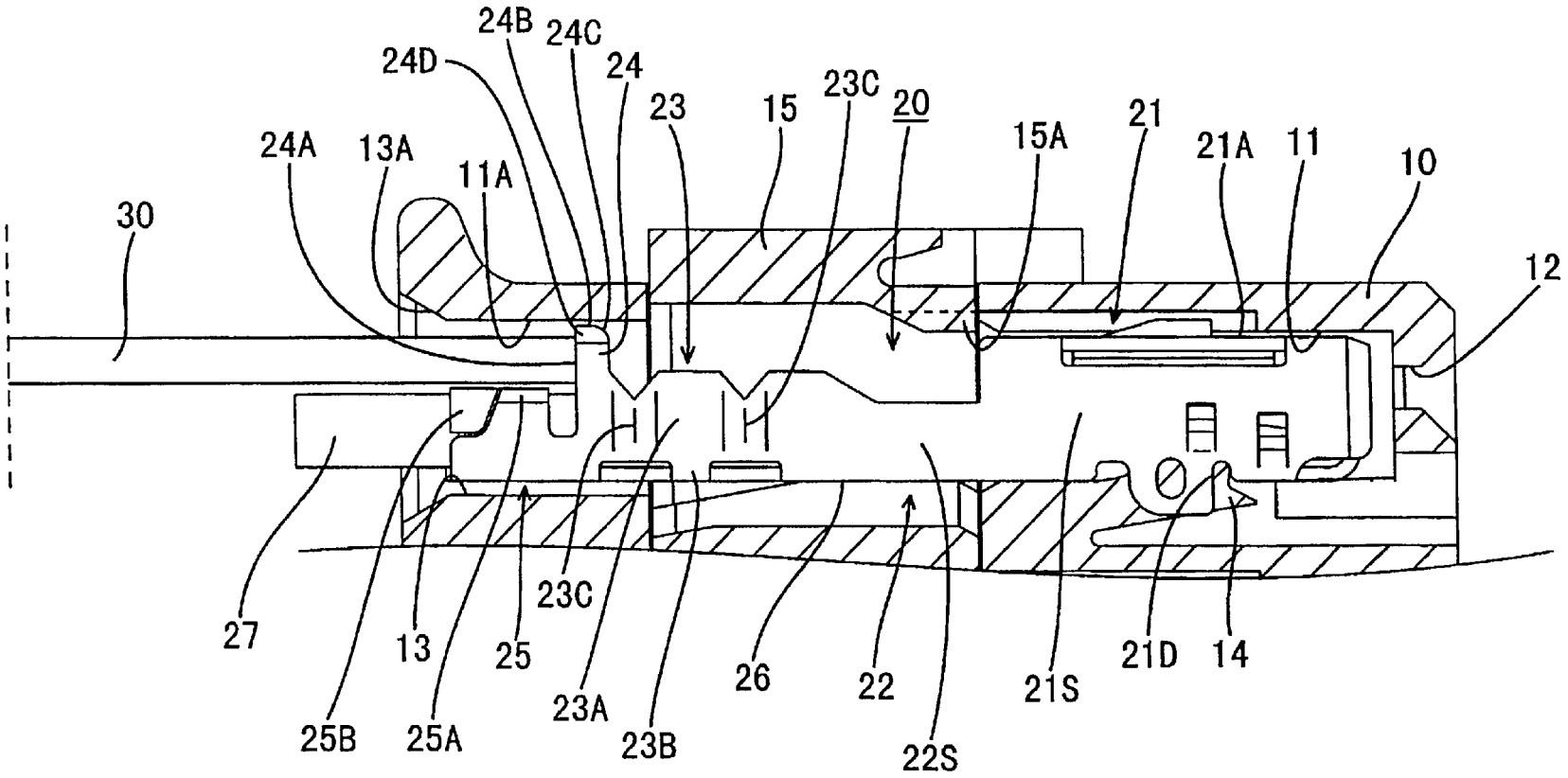
FIG. 4 is a section showing the terminal fitting properly inserted in the connector housing.
Figure 5:
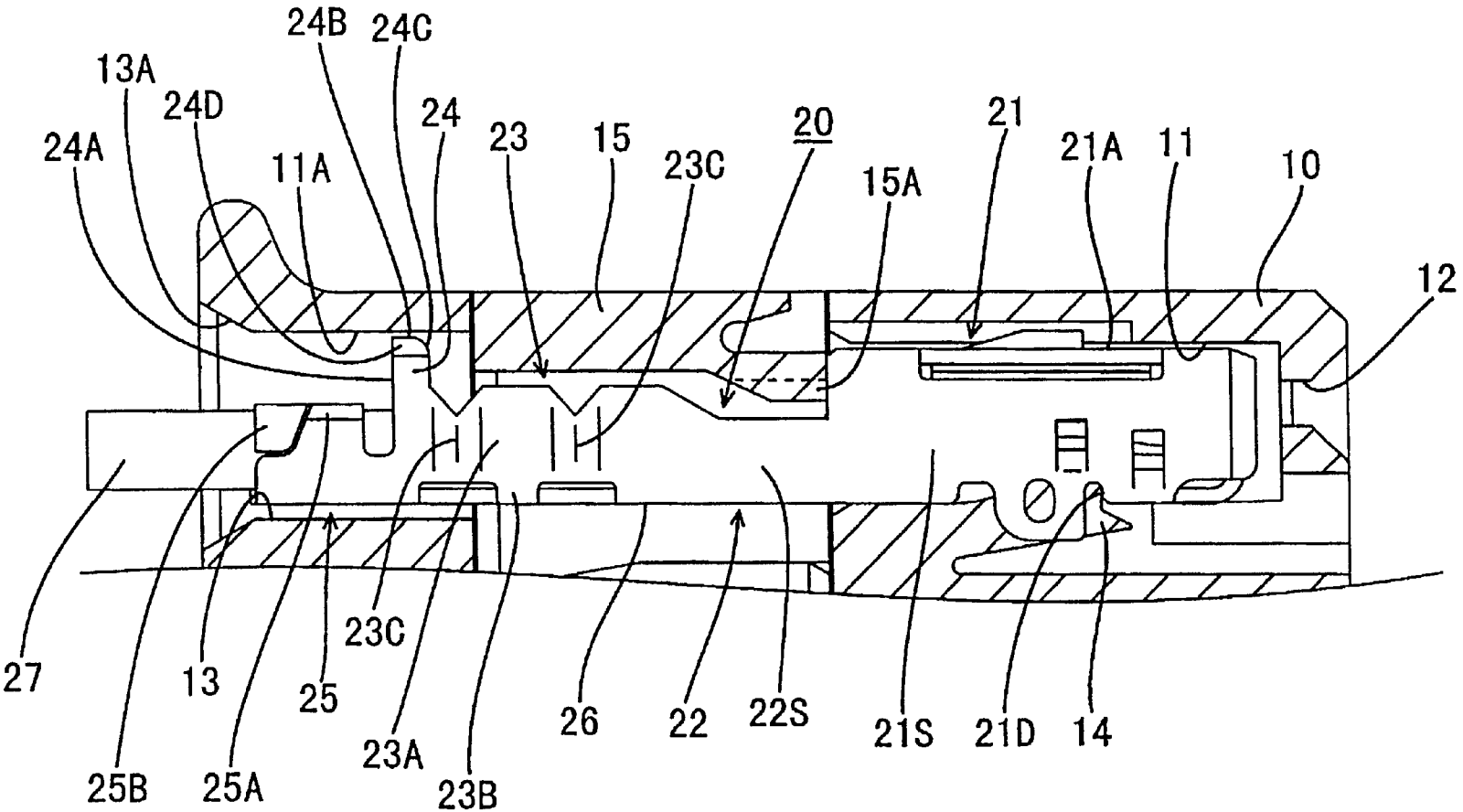
FIG. 5 is a section showing a state where the properly inserted terminal fitting is doubly locked by a retainer.
Figure 6:
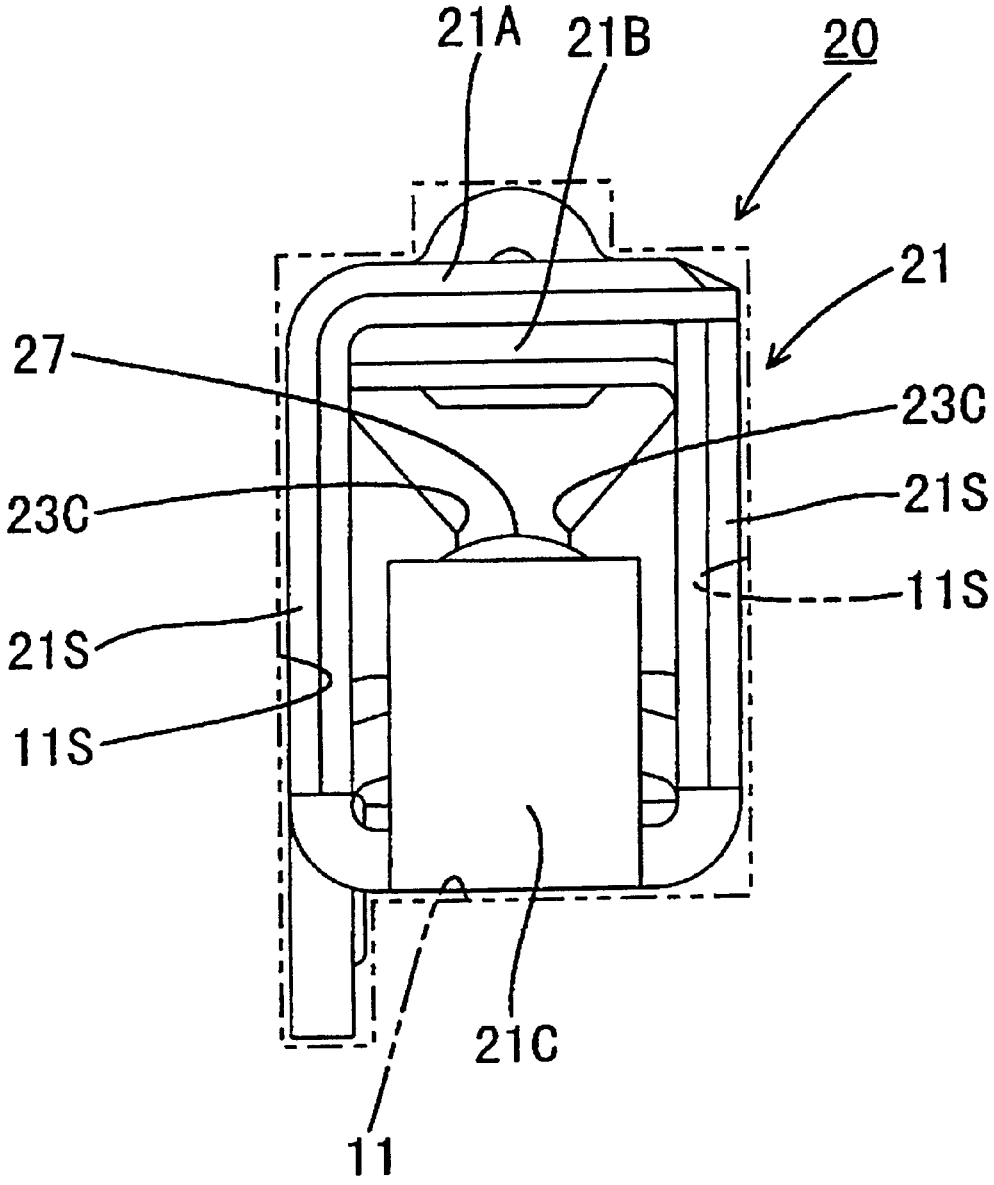
FIG. 6 is a front view of the terminal fitting.

In the following description, the front side corresponds to the right side in FIGS. 2 to 5, the vertical direction is based on the vertical direction in FIGS. 2 to 6, and the lateral direction is based on the lateral direction in FIG. 6. Additionally, the inserting and withdrawing directions of a terminal fitting 20 into and from a cavity 11 are the same as longitudinal or forward and backward directions.

A terminal fitting in accordance with the invention is identified generally by the numeral 20 in the FIGS. 1–6. The terminal fitting 20 can be inserted into a connector housing 10 along an inserting direction ID. The connector housing 10 is formed with at least one cavity 11, which penetrates through the connector housing 10 substantially in forward and backward directions. A connection opening 12 is formed at the front end of the cavity 11 and a terminal insertion opening 13 is formed at the rear end of the cavity 11. The connection opening 12 is dimensioned to receive a tab (not shown) of a mating terminal fitting. A spacing between inner wall surfaces of the cavity 11 is substantially constant from the terminal insertion opening 13 to the back end. A locking portion 14 is formed on the bottom wall of the cavity 11 for locking the terminal fitting 20 after proper insertion into the cavity 11. Further, a retainer 15 is mounted in the connector housing 10 to cross the cavity 11 vertically. The retainer 15 is displaceable between a partial locking position where insertion and withdrawal of the terminal fitting 20 are permitted (see FIGS. 2 to 4) and a full locking position where the terminal fitting 20 is doubly locked (see FIG. 5).

The terminal fitting 20 is formed e.g. by bending a metal plate punched out in a specified shape, and is provided with a connecting portion 21, an extending portion 22, insulation-displacement portions 23, a jig contact portion 24, and a crimping portion 25 which are connected one after another in this order at least along a bottom wall 26.

The connecting portion 21 preferably is in the form of a substantially rectangular tube with opposed open front and rear ends. More particularly, the connecting portion includes the bottom wall 26, a pair of side walls 21S that extend substantially vertically from the left and right sides of the bottom wall 26, and a pair of ceiling walls 21A, 21B. The ceiling walls 21A and 21B extend inwardly from the upper ends of the side walls 21S and preferably are placed substantially one over the other. An elastic contact piece 21C is defined in the connecting portion 21, and is folded back or substantially upward from the front end of the bottom wall 26, as shown in FIG. 6. A tab (not shown) is held tightly between the elastic contact piece 21C and the lower ceiling wall 21B to establish an electrically connected state. Further, a locking hole 21D is formed in the bottom wall 26 of the connecting portion 21, and the terminal fitting 20 is locked in the cavity 11 by the engagement of the locking portion 14 and the locking hole 21D.

The extending portion 22 is comprised of a pair of side walls 22S that extend substantially vertically from the left and right side edges of the bottom wall 26, such that an end of a wire 27 can be accommodated between the side walls 22S.

The crimping portion 25 comprises a pair of barrel portions 25A and 25B that extend substantially vertically from the left and right sides of the bottom wall 26 and that can be displaced in forward and backward directions. The barrel portions 25A and 25B are crimped into connection with the outer surface of the wire 27.

Each insulation-displacement portion 23 is comprised of a pair of laterally spaced apart blade portions 23A that extend between the front ends of the jig contact portion 24 and the rear ends of the side walls 22S of the extending portion 22. The blade portions 23A are connected with the bottom wall 26 via connecting portions 23B only in their center positions with respect to forward and backward directions. Each blade portion 23A is bent inwardly or formed by inwardly bending the side walls 22S to have a V-shape when viewed from above before and behind the corresponding connecting portions 23B. An apex of the V-shape functions as a cutting blade 23C. Two pairs of laterally spaced cutting blades 23C are provided one after the other. The cutting blades 23C cut the resin coating of the wire 27 and electrically connected with a core of the wire 27 that is pushed between the cutting blades 23C from above.

As explained above, the terminal fitting 20 can be secured to the end of the wire 27 outside the connector housing 10 and then inserted into the connector housing 10 using a pushing jig 30 or similar inserting or manipulating means. The jig contact portion 24 has a function of receiving a pushing force exerted from behind by the pushing jig 30. Two jig contact portions 24 in the form of a substantially flat plate extend substantially vertically from the left and right sides of the bottom wall 26. An extending direction of the jig contact portion 24 is substantially normal to the inserting and withdrawing directions of the terminal fitting 20 into and from the cavity 11 and is along the inner side walls of the cavity 11. A spacing between the outer surfaces of the jig contact portion 24, the connecting portion 21, the extending portion 22, the insulation-displacement portions 23 and the crimping portion 25 are less than the inner dimensions of the cavity 11 by a specific clearance in view of the required manufacturing tolerance. A dimension between the lower surface of the bottom wall 26 and the upper edge of the jig contact portion 24 is set shorter than the height of the cavity 11 near the insertion opening 13. This dimensional difference is set in consideration of a dimensional tolerance, an assembling tolerance, and a specified or desired amount of an upward loose movement of the rear end of the terminal fitting 20.

The rear end faces of the jig contact portion 24 extend in a vertical or projecting direction and serve as receiving portions 24A for receiving forward pushing forces exerted by the pushing jig 30. The receiving portions 24A are located above the crimping portion 25, which have already been crimped. Hence, there is no interference between the pushing jig 30 and the crimping portion 25. Further, since the jig contact portions 24 are located behind the insulation-displacement portions 23, the pushing jig 30 also does not interfere with the insulation-displacement portions 23. The upper projecting ends of the jig contact portion 24 serve as contact portions 24B, which face a ceiling wall 11A of the cavity 11 while being slightly spaced apart from the ceiling wall 11A when the terminal fitting 20 is inserted into the cavity 11.

Front ends of upper end portions of the jig contact portion 24 are partly cut away to form guiding portions 24C. The guiding portions 24C are preferably arcuate in side view and extend in a direction substantially oblique to or at an angle different from 0° or 90° with respect to the inserting and withdrawing directions of the terminal fitting 20 into and from the cavity 11. Further, the outer surfaces of the upper end portions of the jig contact portion 24 are slanted when viewed in the inserting and withdrawing directions of the terminal fitting 20 into and from the cavity 11, thereby forming escaping surfaces 24D. Each escaping surface 24D is slanted in such a direction that a distance to the corresponding inner side wall surface of the cavity 11 increases toward the upper end of the jig contact portion 24. In other words, the slanting directions of the escaping surfaces 24D are set such that, if either of the jig contact portions 24 are deformed to lean outward or if the entire terminal fitting 20 is inclined to the left or the right, one of the escaping surfaces 24D approaches a corresponding inner wall surface 11S of the cavity 11 and is held in a position where it extends substantially parallel to the inner wall surface 11S. Further, the inner surfaces of the upper end portions of the jig contact portion 24 are formed into slanted guide surfaces 24E to avoid an interference with the wire 27 that is to be dropped into both the insulation-displacement portions 23 and the crimping portion 25 from above.

The terminal fitting 20 is accommodated in a connecting jig (not shown) outside the connector housing 10, and one end of the wire 27 is secured to the terminal fitting 20 using a pressing jig (not shown) and a crimping jig (not shown). The terminal fitting 20 connected with the wire 27 is inserted into the cavity 11 of the connector housing 10 by the pushing jig 30. The pushing jig 30 is placed such that its lower surface substantially extends along the upper surface of the crimping portion 25 and its leading end is in contact with the receiving portions 24A of the jig contact portion 24 from behind. In this state, the terminal fitting 20 is pushed forward by the pushing jig 30. At this stage, the retainer 15 is held in the partial locking position in the connector housing 10. During the insertion of the terminal fitting 20, the locking portion 14 is pushed up by the bottom wall 26, and thus is deformed elastically (see FIG. 3). When the terminal fitting 20 reaches a proper insertion position, the locking portion 14 is restored substantially to its original shape to engage the locking hole 21D. As a result, the terminal fitting 20 is partly locked (see FIG. 4). The retainer 15 then is pushed down to the full locking position, and a locking portion 15A of the retainer 15 engages the rear ends of the ceiling walls 21A, 21B of the connecting portion 21. As a result, the terminal fitting 20 is locked doubly and will not to come out of the cavity 11.

With the terminal fitting 20 inserted, it is unavoidable to have a clearance between the outer surface of the terminal fitting 20 and the inner surface of the cavity 11 due to manufacturing tolerances. The extending portion 22, the insulation-displacement portions 23 and the crimping portion 25 all have shorter heights than the connecting portion 21, and all are disposed rearward of the connecting portion 21. Consequently, an upward force on the wire 27 may cause the terminal fitting 20 to make a loose pivotal movement substantially about the connecting portion 21, such that the rear of the terminal fitting 20 moves up in a direction that intersects the insertion direction of the terminal fitting 20. At this time, even if the clearance between the connecting portion 21 and the cavity 11 is small, a degree of pivotal displacement of the rear end of the terminal fitting 20 about the connecting portion 21 is large.

However, in this embodiment, the upper ends of the jig contact portion 24 define the contact portions 24B that are spaced only slightly from the ceiling wall 11A of the cavity 11. Accordingly, even if the rear end of the terminal fitting 20 tries to move up, such an upward displacement is restricted by the contact of the contact portions 24B of the jig contact portion 24 with the ceiling wall 11A of the cavity 11 from below. As a result, a loose movement of the terminal fitting 20 can be prevented.

One mode of loose movement restriction in accordance with this embodiment is to set an upward/downward displacement amount of the rear end of the terminal fitting 20 substantially smaller than an upward/downward displaceable range resulting from the clearance between the connecting portion 21 and the inner surface of the cavity 11. Thus, the height of the contact portions 24B is set to provide only a minimum difference between the dimension from the bottom wall 26 to the contact portions 24B and the height of the cavity 11. This minimum height difference is provided to ensure necessary clearances due to manufacturing tolerances. The provision of the contact portions 24B at the maximum height enables the upward/downward displacement amount of the terminal fitting 20 to be a minimum. The height of the contact portions 24B can be reduced if the loose movement permitting range is enlarged. At this time, the height of the contact portions 24B is adjusted in view of the clearance above and/or below the connecting portion 21, the dimension of the connecting portion 21 in forward and backward directions, and a distance between the connecting portion 21 and the jig contact portion 24 in forward and backward directions. These adjustments are made, such that the loose movement amount is substantially smaller than the upward/downward displaceable range due to the clearance above and/or below the connecting portion 21.

Another mode of loose movement restriction is to permit a displacement of the terminal fitting 20 beyond a maximum displaceable range resulting from the clearance above the connecting portion 21 such that any of the extending portion 22, the insulation-displacement portions 23 and the crimping portion 25 undergoes an elastic deformation. However, the displacement is restricted sufficiently to ensure that none of the extending portion 22, the insulation-displacement portions 23 and the crimping portion 25 undergoes a plastic deformation. In this case, the height of the contact portions 24B is adjusted in view of: the clearance above and/or below the connecting portion 21; the dimension of the connecting portion 21 in forward and backward directions; the distance between the connecting portion 21 and the jig contact portion 24 in forward and backward directions; and the shapes and elasticity limits of the extending portion 22, the insulation-displacement portions 23, the jig contact portion 24 and the crimping portion 25. Thus, the loose movement amount lies within a range of elasticity of the terminal fitting 20.

The terminal fitting 20 could be inclined to displace its rear end upward before the jig contact portion 24 enters the cavity 11 during insertion of the terminal fitting 20. In this instance, the upper ends of the jig contact portion 24 interfere with the upper end of the insertion opening 13. However, the upper end of the insertion opening 13 is formed into a slanted guide surface 13A that extends obliquely upward toward the outside. Additionally, the guiding portions 24C are formed at the front ends of the upper end portions of the jig contact portion 24. As a result, the orientation of the terminal fitting 20 is corrected by the contact of the guiding portions 24C and the guide surface 13A. Therefore, the terminal fitting 20 can be inserted without any hindrance.

The terminal fitting 20 could be inclined to the left or the right or the jig contact portion 24 could be deformed outwardly to widen the space between the jig contact portions 24. In this situation, the upper ends of the jig contact portion 24 could contact the side edges of the insertion opening 13. However, since the escaping surfaces 24D are formed on the outer surfaces of the upper ends of the jig contact portion 24, an interference of the jig contact portion 24 with the edge of the insertion opening 13 can be avoided, thereby resulting in a smooth insertion of the terminal fitting 20.

As described above, the jig contact portions 24 are formed to enable the pushing jig 30 to insert the terminal fitting 20 and also to restrict loose movement of the terminal fitting 20 in the cavity 11. Therefore, it is not necessary to form a loose movement-restricting portion separately from the jig contact portion 24. This enables an avoidance of a complicated shape and an enlarged size of the entire terminal fitting 20.

Further, if an attempt is made to reduce the size of the terminal fitting 20 while forming a loose movement restricting portion separately from the jig contact portion 24, the jig contact portion 24 and the loose movement restricting portion must be small, and therefore have a reduced strength. However, the jig contact portion 24 of this embodiment has both the function of contacting the jig and the function of restricting a loose movement of the terminal fitting 20 inside the cavity 11 of the connector housing 10. Thus, the terminal fitting 20 is allowed to have a sufficient strength by forming the jig contact portion 24 in maximally large size.

Since the jig contact portion 24 projects in a direction that intersects with the insertion direction of the terminal fitting 20 into the cavity 11, the shape of the jig contact portion 24 can be simple.

The present invention is not limited to the above embodiment. For example, following embodiments also are embraced by the technical scope of the invention as defined in the claims. Besides these embodiments, various changes can be made without departing from the scope and spirit of the invention as defined in the claims.

Although the present invention is applied to the female terminal fitting in the foregoing embodiment, it is also applicable to male terminal fittings.

Although the wire is secured to the terminal fitting by insulation displacement and crimping in the foregoing embodiment, the present invention is also applicable to terminal fittings to which wires are secured only by insulation displacement or only by crimping.

What is claimed is:

1. A terminal fitting to be connected with a wire outside a connector housing and to be inserted into a cavity in the connector housing by a pushing jig, the terminal fitting comprising opposite front and rear ends, a top, a bottom and first and second sides, a connecting portion extending rearwardly from the front end and configured for connection with a mating terminal, crimping portions at the rear end and configured for crimped connection with the wire, first and second jig contact portions disposed at the respective first and second sides and between the connecting portion and the crimping portions, the jig contact portions and the crimping portions being dimensioned respectively for permitting engagement of the jig contact portions by the pushing jig, for pushing the terminal fitting into the cavity, the jig contact portion further being dimensioned for restricting a loose movement of the terminal fitting in the cavity in a direction that intersects an inserting direction of the terminal fitting by contacting an inner wall of the cavity.

2. A terminal fitting according to claim 1, wherein the jig contact portion projects in a direction that intersects the insertion direction of the terminal fitting, the jig contact portion having an edge extending along the projecting direction of the jig contact portion and serving as a receiving portion that is dimensioned and disposed for receiving the pushing jig, the jig contact portion further having a projecting edge that serves as a contact portion and that is disposed for contacting the inner wall of the cavity.

3. A terminal fitting according to claim 1, wherein the terminal fitting defines a plurality of different heights measured between the bottom and the top of the terminal fitting at different locations between the front and rear ends of the terminal fitting, the height defined by the jig contact portions being greater than heights at all locations between the jig contact portion and the rear end of the terminal fitting.

4. A terminal fitting according to claim 1, wherein the terminal fitting is an insulation-displacement terminal fitting having at least one insulation displacement portion disposed between the jig contact portions and the connecting portion.

5. A connector comprising:

a connector housing having at least one cavity with opposed front and rear ends and a plurality of inner wall surfaces extending between the front and rear ends of the cavity, the cavity defining at least one inner height between two opposed inner wall surfaces;

a wire; and at least one terminal fitting inserted into the cavity by a pushing jig having a selected cross-sectional dimension, the terminal fitting having opposed front and rear ends disposed respectively in proximity to the front and rear ends of the cavity, opposite first and second sides extending between the front and rear ends, a connecting portion extending rearwardly from the front end of the terminal fitting and defining a height that is a first selected distance less than the inner height of the cavities adjacent the connecting portion, first and second jig contact portions rearwardly of the connecting portion and adjacent the respective first and second sides and defining a height that is a second selected distance less than the inner height of the cavity adjacent the jig contact portion, the second distance being less than the first distance, the height of the jig contact portions being selected to enable contact by the jig moved into the cavity and passed the rear end of the terminal fitting.

6. A terminal fitting according to claim 5, wherein inner surfaces of upper end portions of the jig contact portion comprise slanted guide surfaces facing one another for guiding the wire to be connected with the terminal fitting.

7. A connector according to claim 5, wherein the connector housing comprises a terminal inserting opening having at least one slanted guide surface for guiding the insertion of the terminal fitting into the cavity.

8. A connector according to claim 5, wherein the terminal fitting is an insulation-displacement terminal fitting and comprises at least one insulation-displacement portion between the jig contact portions and the connecting portion.

9. A terminal fitting according to claim 5, wherein the cavity defines and insertion direction extending between the front and rear ends, and wherein the jig contact portion further comprises a projecting end portion formed with a guiding portion extending in a direction oblique to the inserting direction of the terminal fitting into the cavity.

10. A terminal fitting according to claim 9, wherein the jig contact portion projects along an inner wall surface of the cavity in a direction that intersects the insertion direction of the terminal fitting into the cavity, and a slanted escaping surface being formed on an outer surface of a projecting end portion of the jig contact portion.

11. A terminal fitting stamped and formed from a unitary piece of metal plate material, said terminal fitting having opposed front and rear ends and defining an insertion direction extending linearly between said ends, said terminal fitting comprising: a connecting portion at said front end configured for connection with another terminal fitting, a crimping portion at the rear end crimped into connection with a wire, and two spaced-apart jig contact portions between said ends, said jig contact portions each having a receiving edge projecting substantially normal to the insertion direction and facing said rear end of the terminal fitting, a contact edge parallel to the insertion direction and extending forwardly from the receiving edge, a guiding edge tapered obliquely forwardly from the contact edge, said jig contact portions further having inner surfaces facing one another and outer surfaces facing away from one another, the outer surfaces comprising escaping surfaces adjacent the contact edge and tapered inwardly toward the inner surface, the inner surfaces comprising guide surfaces adjacent the contact surface and tapered outwardly toward the outer surface.

12. A terminal fitting according to claim 11, further comprising at least one insulation-displacement portion between the jig contact portions and the connecting portion.

13. A terminal fitting according to claim 12, wherein the jig contact portions are spaced from both the crimping portion and the insulation-displacement portion.

14. A terminal fitting according to claim 11, wherein the terminal fitting has a plurality of different heights measured perpendicular to the insertion direction at a plurality of locations between said front and rear ends of the said terminal fitting, a height defined by the jig contact portions being greater than the height at all locations on the terminal fitting between the jig contact portions and the rear end of the terminal fitting.

* * * * *